United States Patent [19]

Bogese

[11] Patent Number: 4,460,234

[45] Date of Patent: Jul. 17, 1984

[54] DOUBLE-ENDED MODULAR JACK

[75] Inventor: Charles E. Bogese, Roanoke, Va.

[73] Assignee: Virginia Patent Development Corporation, Roanoke, Va.

[21] Appl. No.: 303,603

[22] Filed: Sep. 18, 1981

[51] Int. Cl.[3] ..... H01R 9/03

[52] U.S. Cl. ..... 339/128; 339/176 M; 339/205; 339/222

[58] Field of Search ..... 339/128, 176 M, 205, 339/222

[56] References Cited

U.S. PATENT DOCUMENTS

| | | | |
|---|---|---|---|
| 3,354,422 | 11/1967 | Duris | 339/128 |
| 3,954,320 | 5/1976 | Hardesty | 339/99 R |
| 4,082,409 | 4/1978 | Bailey et al. | 339/205 |
| 4,153,327 | 5/1979 | Johnson | 339/205 |
| 4,268,109 | 5/1981 | Hardesty | 339/205 |
| 4,273,402 | 6/1981 | Hughes | 339/205 |
| 4,274,691 | 6/1981 | Abernethy et al. | 339/176 MP |
| 4,367,908 | 1/1983 | Johnston | 339/205 |
| 4,379,609 | 4/1983 | Hardesty | 339/91 R |

FOREIGN PATENT DOCUMENTS

| | | | |
|---|---|---|---|
| 1050131 | 3/1979 | Canada | 339/176 M |
| 2430707 | 1/1976 | Fed. Rep. of Germany | 339/128 |

*Primary Examiner*—Joseph H. McGlynn
*Assistant Examiner*—Gary F. Paumen
*Attorney, Agent, or Firm*—Saidman, Sterne & Kessler

[57] ABSTRACT

A modular connector or coupler (10) for electrically connecting two cordsets each of which is terminated by a modular plug. The coupler is characterized by a central partition (49, 49') extending transversely to the longitudinal axis of the coupler for supporting a plurality of side-by-side conductors (70) therethrough. The conductors extend from both sides of the partition into plug-receiving cavities (40, 40') formed on each side of the partition. The ends of the conductors in each cavity comprise spring contacts (76, 76') adapted to mate with correspondingly aligned contact terminals (78, 78') similarly spaced in the mating modular plug (60, 60'). The two plug-receiving cavities may be arranged as mirror images of one another along the partition whereby the signals on the respective contact terminals of the two modular plugs will be positionally transposed. Alternatively, the cavities may be reverse images of one another whereby the signals on the respective contact terminals of the mating plugs will be positionally matched.

54 Claims, 11 Drawing Figures

FIG. 1
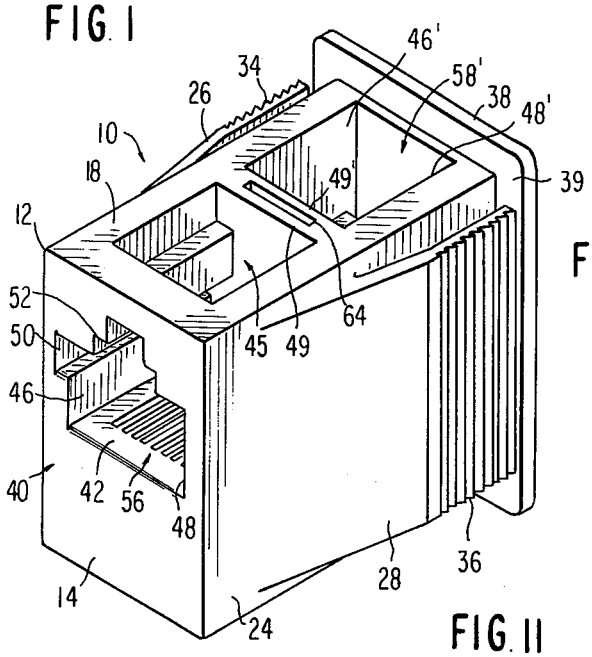
FIG. 7
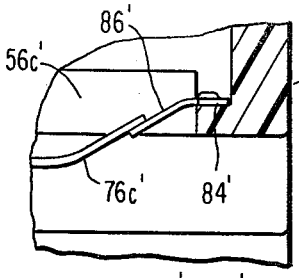
FIG. 8
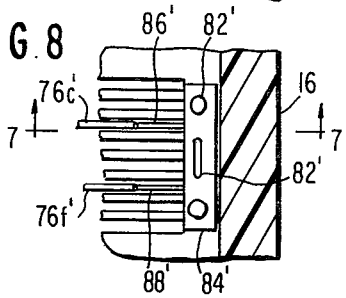
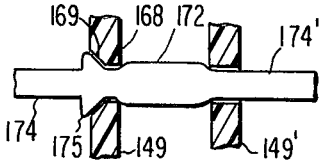
FIG. 11
FIG. 2
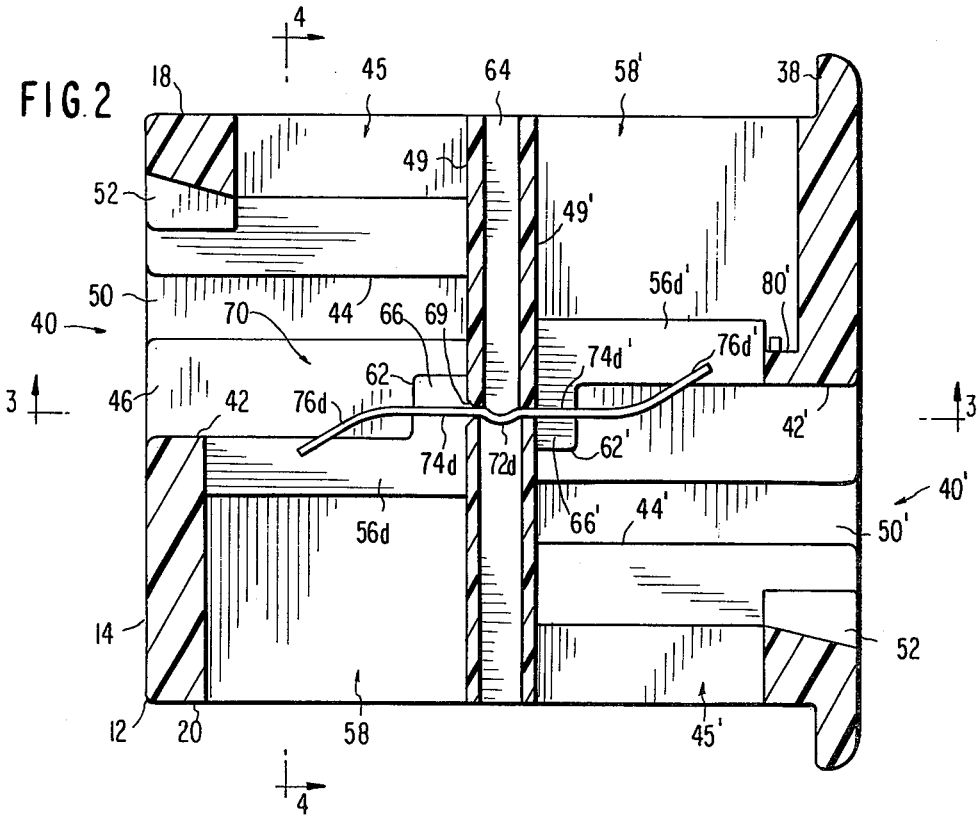

FIG. 3
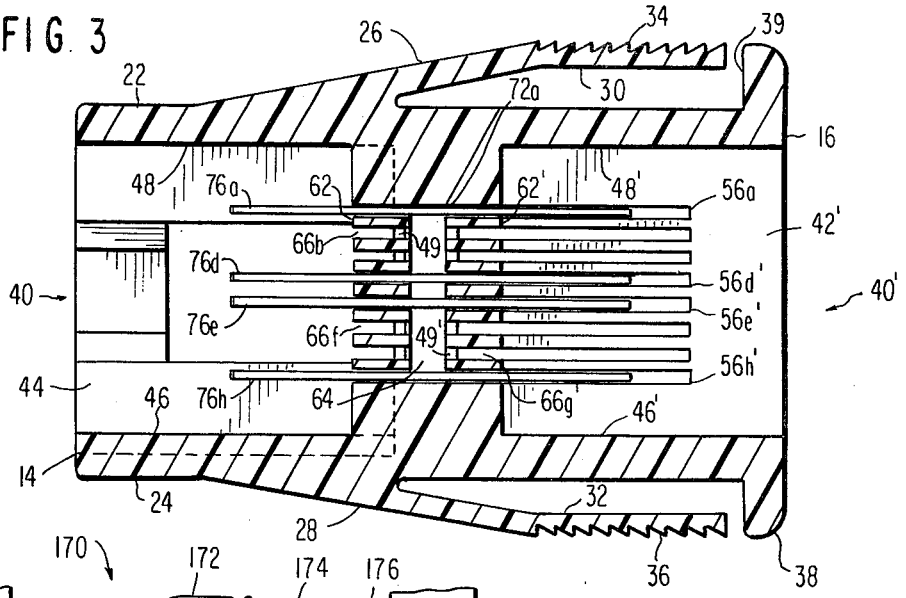
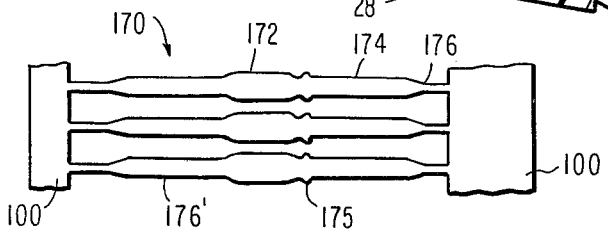
FIG. 10
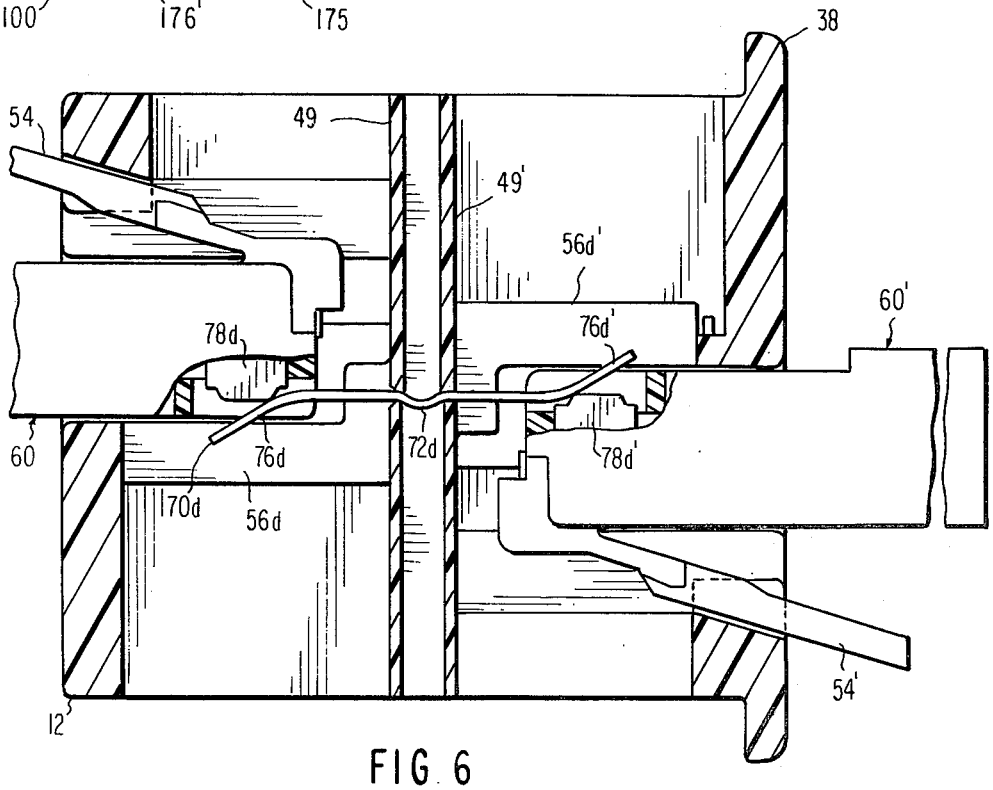
FIG. 6

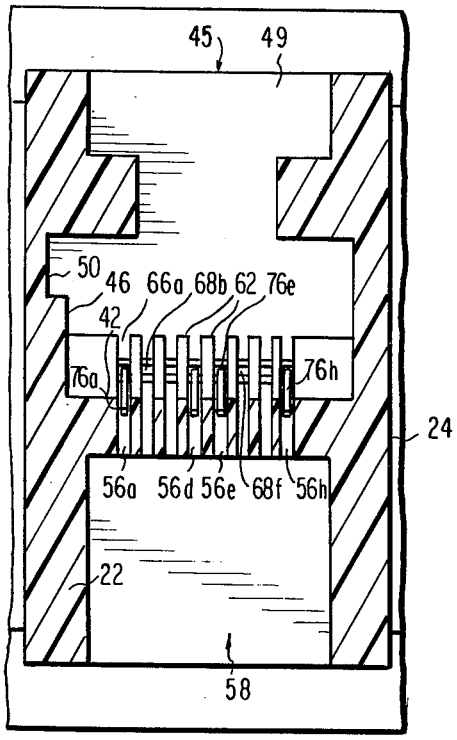
FIG. 4
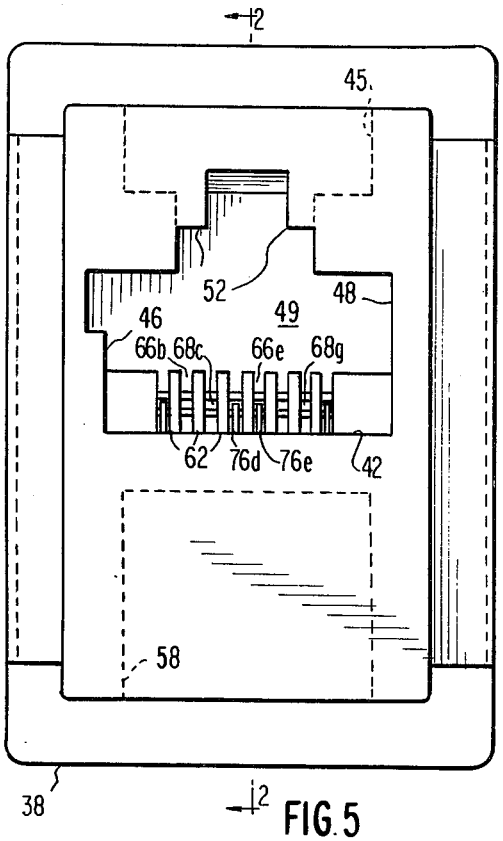
FIG. 5
FIG. 9
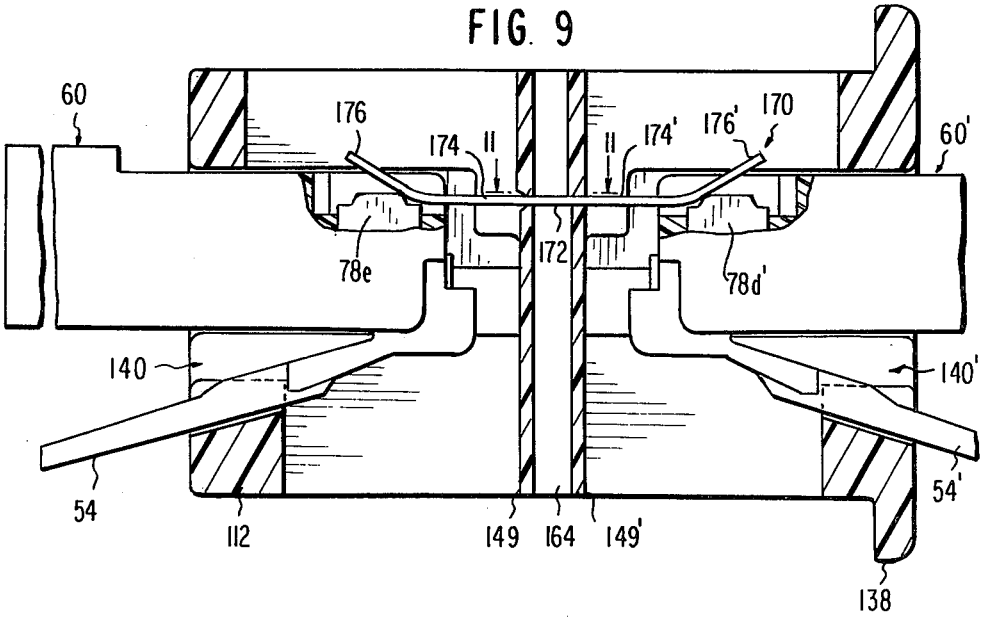

DOUBLE-ENDED MODULAR JACK

BACKGROUND OF THE INVENTION

1. Field of the Invention

The present invention is related to electrical connector receptacles or jacks and, more particularly, is directed towards a double-ended connector receptacle intended for use as an interconnect device between two multiple-conductor cables each terminated by a modular plug.

2. Description of the Related Art

The desirability of providing a double-ended connector receptacle for end-to-end connection of modular plugs is recognized in U.S. Pat. Nos. 4,153,327 and 4,273,402. Both constructions taught in these patents are characterized by the provision of a dielectric housing and a pair of cavities opening into each end thereof. Each cavity is particularly designed and sized to receive a mating modular plug of the type described, for example, in U.S. Pat. No. 3,954,320 to Hardesty. Such plugs have gained wide acceptance in the communications industry, and are becoming increasingly popular devices for use with general electrical and electronic interconnect equipment.

The double-ended jacks of the prior art are further characterized by the provision of a plurality of side-by-side, spaced apart conductors whose central portions extend through or along the floor or roof of the housing. From their central portion the ends of each conductor extend through apertures formed near the outer ends of the housing which communicate with the plug-receiving cavities. Each extending end of the conductor is then bent rearwardly back into the associated plug-receiving opening so as to form rearwardly extending spring contacts within each cavity adapted to mate with correspondingly spaced contact terminals in the associated modular plug.

As a result, the prior art design requires a conductor length which is approximately twice as long as the combined lengths of the spring contact portions themselves. Since such contacts typically must be gold-plated to provide the required conductivity upon mating, it may be appreciated that the overall length of the conductors greatly affects the cost of the connector. It would therefore be highly desirable to provide a double-ended jack where the conductor length is reduced.

Also, the connector of the above-noted '327 patent comprises three plastic parts, in addition to the conductors, which must be fit together in a precise arrangement. The connector of the above-noted '402 patent is an improvement in teaching a two part housing which results in improved reliability and lower assembly cost when compared with the three part housing. It would also be desirable, for the same reasons, to provide a double-ended jack having a unitary, integrally molded housing.

Furthermore, both of the double-ended connector receptacles of the prior art patents cited are adapted to receive their respective mating plugs in a manner which will transpose the signal from, for example, position 1 on one plug to position 8 on the other plug (in an eight position jack-plug design). In other words, the prior art designs are such that a user must take into account the fact that the signals between the two mating plugs will be positionally transposed. For various reasons, it may be desirable that such signal transposition not take place.

The present invention constitutes an improvement over and, inter alia, overcomes the above-noted disadvantages and deficiencies of prior art connectors.

SUMMARY OF THE INVENTION

The present invention provides a double-ended modular jack for coupling a pair of modular plugs in a manner which, in one embodiment, eliminates positional transposition of the signals on the various contact terminals of the plugs. Further, the conductors positioned within the coupler housing are arranged to reduce substantially their overall length. Further, the housing is constructed of a single, unitary plastic molded part so as to greatly minimize assembly costs and provide improved reliability.

In accordance with one aspect of the present invention, there is provided a double-ended modular jack which comprises a dielectric housing having first and second ends and first and second plug-receiving cavities extending inwardly from the first and second ends, respectively. Each of the cavities are adapted to receive a modular plug. A plurality of electrical conductors are positioned in a side-by-side spaced apart fashion in the housing. Each of the conductors includes a central portion and first and second end portions extending from respective ends of the central portion into the first and second cavities respectively towards the first and second ends of the housing. Each first and second end portion comprises spring contact means for establishing electrical contact with correspondingly aligned contact terminals located in the first and second modular plugs, respectively.

In accordance with another aspect of the present invention, the housing further includes partition means extending approximately through the central portion of the housing, the partition means including means for supporting the central portions of the conductors. The supporting means more particularly comprises a plurality of side-by-side spaced apart apertures extending across the partition means.

In accordance with more specific aspects of the present invention, each of the plug receiving cavities includes opposed inner side walls, an inner end wall extending between the opposed inner side walls, and a plurality of side-by-side spaced apart slot means formed in the inner end wall for receiving the free ends of the spring contact means therein. The slot means are aligned with the apertures formed in the partition means, and there are preferably further provided a plurality of side-by-side spaced walls extending substantially perpendicularly from the partition means so as to form a plurality of side-by-side, spaced slots, which are aligned with and adjacent the apertures in the partition means and are coextensive with the slot means formed in the end walls.

In accordance with another aspect of the present invention, the apertures in the partition means are positioned in a plane which is spaced from the plane or planes containing the inner end walls of the first and second cavities. The partition means may comprise first and second inner rear walls for the respective plug-receiving cavities, such walls being spaced from one another to form an elongated cavity therebetween through which the central portions of the conductors transversely extend.

In accordance with another aspect of the present invention, the inner end walls of the first and second cavities are respectively positioned in first and second planes, the apertures formed in the first and second inner rear walls being positioned in a third plane which is spaced from the first and second planes. The latter are located in one embodiment approximately equidistantly on opposite sides from the third plane whereby the first and second cavities are reverse images of one another. Alternatively, the first and second planes are approximately coplanar and are equidistantly spaced from the third plane whereby the first and second plug-receiving cavities are mirror images of one another.

Stated another way, in one embodiment, the first end portions of the conductors extend in the first cavity generally obliquely downwardly towards the first end of the housing, while the second end portions of the conductors extend in the second cavity generally obliquely upwardly towards the second end of the housing. In this manner, the associated plugs are received in reverse positions to avoid signal transposition; in other words, the signals will be positionally matched. Alternatively, the first and second end portions of the conductors extend respectively in the first and second cavities generally obliquely upwardly towards the first and second ends of the housing, respectively, whereby the signals in the respective plugs will be positionally transposed.

In accordance with another aspect of the present invention, means may be provided which are selectively attachable to the housing for shorting at least two of the second end portions of the conductors together only when the contact terminals of the second modular plug are not in electrical contact with such two second end portions. Means may also be provided for mounting the housing to an apertured panel, which means comprises a flange positioned at the second end of the housing which extends peripherally beyond the outer side walls and outer end walls thereof. The mounting means may further include a pair of complimentary spring arms flexibly extending respectively from the opposed outer side walls for securing the housing in the aperture of the panel. Each of the spring arms preferably includes an outer, serrated surface adapted to grip the inner opposed edges of the aperture in the panel.

In accordance with yet another aspect of the present invention, the conductors may either comprise drawn wires or stamped and formed conductors. In the case of the latter, they are designed to include means for facilitating proper seating thereof in the housing, means for retaining same in the housing, and means for preventing rotation thereof in the housing.

BRIEF DESCRIPTION OF THE DRAWINGS

The foregoing and other aspects of the invention will be more fully appreciated as the same becomes better understood from the following detailed description of the present invention when considered in conjunction with the accompanying drawings, in which:

FIG. 1 is a perspective view of a preferred embodiment of a double-ended modular jack in accordance with the present invention;

FIG. 2 is a side sectional view of the preferred embodiment illustrated in FIG. 1;

FIG. 3 is a top sectional view of the preferred embodiment illustrated in FIGS. 1 and 2 and taken along line 3—3 of FIG. 2;

FIG. 4 is a cross-sectional view of the preferred embodiment of FIGS. 1 and 2 and which is taken along line 4—4 of FIG. 2;

FIG. 5 is an end view in elevation of the preferred embodiment illustrated in FIG. 2;

FIG. 6 is a side sectional view similar to FIG. 2 but illustrating the mating plugs in place within the connector housing;

FIG. 7 is a side sectional view of a portion of the preferred embodiment illustrating the utilization of a shorting bar assembly;

FIG. 8 is a top view of the portion illustrated in FIG. 7;

FIG. 9 is a side sectional view illustrating an alternate embodiment of the present invention;

FIG. 10 is a plan view of a portion of stamped conductors which may be employed in connection with the present invention; and FIG. 11 is an enlarged view of a stamped conductor of FIG. 10 illustrated in place within the housing of FIG. 9 and taken along line 11—11 thereof.

DETAILED DESCRIPTION OF THE PREFERRED EMBODIMENTS

Referring now to the drawings, wherein like reference numerals represent identical or corresponding parts throughout the several views, and more particularly to FIGS. 1-3 thereof, a double-ended modular jack or coupler is indicated generally by reference numeral 10. As will become more clear hereinafter, coupler 10 is specially designed so as to be formed as a unitary, integrally molded, single piece of plastic, thereby substantially reducing assembly cost and resulting in a more reliable device.

Coupler 10 includes a dielectric housing 12 having first and second ends 14 and 16. Extending between ends 14 and 16 are a pair of opposed, outer side walls 22 and 24, as well as a pair of opposed, outer end walls 18 and 20.

Although not necessary to the basic structure of the present invention, the illustrated embodiment includes means for permitting the housing 12 to be mounted through an aperture formed in a panel. Such panel mounting means preferably comprises a pair of complimentary, opposed arms 26 and 28 which extend integrally from outer side walls 22 and 24 near the first end 14. Arms 26 and 28 include parallel spring portions 30 and 32 each of which includes serrations or teeth 34 and 36, respectively, formed along the outer surface thereof. Spring portions 30 and 32 extend in a cantilevered fashion from outer side walls 22 and 24 towards the second end 16 so as to provide flexibility and springiness. Formed about the second end 16 and extending laterally outwardly beyond the periphery of outer walls 18, 20, 22 and 24 is a flange 38 which is designed to fit about the outer rim of the panel aperture.

In operation, the first end 14 of housing 12 is initially placed through the panel aperture (not shown). Continued insertion of the housing 12 will force the spring portions 30 and 32 inwardly towards the side walls 22 and 24. Continued insertion forces the teeth 34 and 36 past the opposed side edges of the aperture in a ratchet-like manner until the inside surface 39 of flange 38 abuts the outer periphery of the aperture. Depending upon the thickness of the panel, one pair of teeth from the plurality of teeth 34 and 36 will lock onto the opposed side edges of the aperture to secure the housing in place.

It should be understood that the coupler 10 of the present invention may be manufactured without the arms 26 and 28 and associated flange 38, depending upon the desired use.

Opening onto the first and second ends 14 and 16, respectively, are a pair of plug-receiving cavities 40 and 40'. Each of the plug-receiving cavities 40 and 40' are substantially identical in internal construction and are specifically designed and sized so as to receive a modular plug of the type illustrated, for example, in U.S. Pat. No. 3,954,320 to Hardesty, which is specifically incorporated herein by reference. A pair of such plugs are illustrated, for example, in FIG. 6 and are indicated by reference numerals 60 and 60'.

Inasmuch as the internal structure of cavities 40 and 40' are substantially identical, corresponding parts of the second cavity 40' are indicated herein by a primed reference numeral. It should be understood, however, that positionally the respective cavities 40 and 40' are, in this embodiment, reverse images of one another, that is, the position of cavity 40' is essentially defined by a 180 degree rotation relative to cavity 40 about a central transverse axis through housing 12.

The "reverse image" construction of the embodiment of FIGS. 1–6 is to be distinguished from the "mirror image" constructions which prevail in the prior art as evidenced by U.S. Pat. Nos. 4,153,327 and 4,273,402 wherein the plug-receiving cavities are mirror images taken along a plane which transversely bisects the respective connector housings. The "mirror image" construction is illustrated as an alternate embodiment of the present invention in FIG. 9 and will be described in greater detail hereinafter.

Still with reference to FIGS. 1–5, each plug-receiving cavity 40, 40' includes opposed inner end walls 42, 42' and 44, 44'. The inner end walls are connected by opposed inner side walls 46, 46' and 48, 48'. Extending between the inner side walls are inner rear walls or partitions 49 and 49'.

Formed on one end of plug-receiving cavities 40 and 40' are a pair of large open cavities 45 and 45', while extending into the other end of each plug-receiving cavity are another pair of large, open cavities indicated by reference numerals 58 and 58'. Cavities 58, 58' are provided to accommodate forming tools, as will be described in greater detail hereinafter, and, together with cavities 45, 45' lend economy to the structure by eliminating unnecessary material.

Inner side walls 46, 46' may include a keyway slot 50, 50' for receiving an appropriately keyed male plug therein. The upper inner end walls 44, 44' also include spaced shoulders 52, 52' for receiving and locking a flexible latching arm 54, 54' (FIG. 6) of the respective mating plugs.

Extending longitudinally along the inner, bottom end walls 42, 42' are a plurality of side-by-side slots 56, 56'. The side-by-side slots 56, 56' preferably extend through the inner bottom end walls 42, 42' to the large cavities 58, 58'.

As shown more clearly in FIG. 4, eight such slots 56 are illustrated in this embodiment, although it will be understood that greater or fewer slots could be provided. The eight slots in the illustrated embodiment are indicated by suffix letters a, b, c, d, e, f, g and h, as are the corresponding aligned holes, apertures, conductors and contact terminals, as will be described in greater detail hereinafter.

The rear inner walls or partitions 49, 49' are relatively thin and preferably define an open, elongated cavity 64 formed therebetween for a purpose to be described more fully below.

A plurality of substantially parallel walls 62, 62' preferably extend perpendicularly from respective rear walls or partitions 49, 49' to form side-by-side slots 66, 66' which extend above the plane of inner bottom end walls 42, 42'. Slots 56, 56' formed in bottom wall 42, 42' are aligned with respective slots 66, 66', and are preferably formed by the same dividing walls 62, 62'.

Formed in partition wall 49 of cavity 40 so as to be colinear with slots 56 and 66 are a plurality of side-by-side apertures or holes 68. Aligned with holes 68 are a plurality of side-by-side apertures 68' formed in rear wall or partition 49' of cavity 40'. The entranceway to apertures 68 in partition 49 may be tapered as indicated by reference numeral 69 (FIG. 2) to facilitate insertion of the individual conductors, as will be described below. Further, the shape of apertures 68' in partition 49' is preferably rectangulaar to receive complimentary-shaped stamped and formed conductors and prevent rotation thereof about their axes after insertion.

Extending through apertures 68 and 68' are a plurality of side-by-side conductors 70 which are indicated by suffix reference letters in accordance with their position, as explained above. Generally, each conductor 70 includes a central portion 72 from each end of which extends respective intermediate portions 74, 74' which, in turn, terminate in respective spring contact portions 76, 76'. Spring contacts 76, 76' have free ends which are adapted to freely move within aligned slots 56, 56'.

In the embodiment of FIGS. 1–6, the spring contact portion 76 may be said to extend within the plug-receiving cavity 40 obliquely downwardly towards the first end 14 of the housing 12, while the spring contact portion 76' extends obliquely upwardly within cavity 40' towards the second end 16 of the housing 12. In other words, spring contact portions 76 and 76' are oriented in an opposite sense to one another as a result of the reverse image positioning of their associated plug-receiving cavities 40, 40'.

The spring portions 76, 76' of conductors 70 are preferably plated with a high conductivity metal, such as gold, for added contact integrity and reliability. In certain cases, however, the entire length of the conductors 70 may be gold plated. It therefore may be appreciated that the present invention, in utilizing forwardly-extending spring contact portions 76, 76', as opposed to the rearwardly-extending spring contact design of the prior art, greatly reduces the overall conductor length and thereby results in substantial cost savings.

The conductors 70 may comprise either drawn wires or stamped and formed pieces of sheet metal. Formed wire conductors 70 are illustrated in the first embodiment of FIGS. 1–6. Such conductors are provided in substantially linear segments of predetermined length. In assembling the coupler 10 of the first embodiment, the respective side-by-side conductors are initially inserted through the desired apertures 68 in partition 49. The initial insertion may be facilitated by the provision of tapered openings 69. The conductors continue to be inserted through aligned apertures 68' in partition 49'. After the conductors 70 are properly located in apertures 68, 68', a forming tool is inserted in both ends of open-ended cavity 64 to form a dimple (indicated by reference numeral **72*d* in FIG. 2) in the central portion 72 of conductors 70. The dimple 72*d* assists in retaining conductor 70 in the proper location within partitions 49, 49'. Thereafter, a forming tool is inserted in cavities 40 and 58 to bend spring contact end 76*d* downwardly, and a forming tool is inserted in cavities 40' and 58' to bend end 76*d'* upwardly. After the forming operation is concluded, the cavities 40 and 40' are ready to receive respective mating plugs 60 and 60', as illustrated in FIG. 6** to which attention is now directed.

Conventionally, as set forth in the above-cited Hardesty '320 patent, each mating plug 60, 60' includes a plurality of substantially planar, side-by-side insulation-piercing contact terminals 78 and 78'. Each contact terminal, such as terminal **78*d*, is designed to make spring contact with the aligned end portion 76*d* of the associated conductor 70*d*. Similarly, the contact terminal 78*d'* is adapted to make spring contact with the exposed end portion 76*d'* of the other end of the same conductor 70*d***.

As is conventional, the other ends of the contact terminals **78*d*, 78*d'* include insulation-piercing tangs which make electrical contact with aligned insulated wires (not shown) that are terminated in respective plugs 60, 60'**.

It may be appreciated from FIG. 6 that the "reverse image" configuration of this embodiment eliminates signal position transposition in the respective mating plugs 60 and 60' which was prevalent in the prior art designs. In other words, the contact terminal in the fourth position of plug 60 (contact terminal **78*d*) will be electrically connected through conductor 70*d* to the contact terminal in the fourth position of plug 60' (contact terminal 78*d'***) and the signals at these terminals will be positionally matched.

Referring now to FIGS. 7 and 8, there is illustrated a metallic shorting bar 84' having a pair of integrally extending fingers 86' and 88' in the third and sixth positions (positions c and f) of the slots 56'. Metallic shorting bar 84' may be secured to the housing 12 by means of shorting bar posts 82' formed on a ledge 80' in cavity 58'. Metallic shorting bar 84' includes apertures for receiving posts 82' therein.

Fingers 86' and 88' are adapted to come into electrical contact with spring contact portions **76*c'* and 76*f'*, respectively, (see FIG. 7) as long as the associated mating plug 60' is not in its fully inserted position in plug-receiving cavity 40'. When the plug 60' is fully inserted, the aligned contact terminals 78*c'* and 78*f'* (not shown) will urge associated spring contact portions 76*c'* and 76*f'* out of contact with fingers 86' and 88'**, respectively.

Referring now to FIG. 9, there is illustrated an alternate embodiment of the present invention wherein the major difference when compared with the first embodiment is that the plug-receiving cavities 140 and 140' of FIG. 9 are constructed in a "mirror image" relationship with respect to a plane extending transversely through the mid-portion 164 of the housing 112. In this construction, the orientation of plug 60 is reversed from the embodiment of FIG. 6. This results in a signal position transposition between the signals on contact terminals 78 of plug 60 and contact terminals 78' of plug 60'. As illustrated in FIG. 9 this means that the signal on the fourth contact terminal **78*d'* of plug 60' will be transmitted along conductor 170 to the fifth contact terminal 78*e* of plug 60. Similarly, a signal on the first contact terminal (not shown) of plug 60' will be transposed to the eighth contact terminal (not shown) of plug 60, a signal on the second contact terminal of plug 60' will be transposed to the seventh contact terminal of plug 60, et cetera. In this embodiment, the aligned apertures in barrier walls 149, 149' are positioned slightly off center from their position illustrated in FIG. 6. Further, in the embodiment of FIG. 9, a stamped and formed conductor 170 is utilized which includes a central portion 172, intermediate portions 174, 174', and spring contact portions 176, 176'**.

Several stamped conductors 170 are illustrated in FIG. 10 attached to their respective carrier strips 100 prior to severing and being inserted into housing 112. The central portions 172 of conductors 170 are enlarged with respect to the width of the spring contact portions 176, 176'. Wedge-shaped portions 175 are preferably located between central portions 172 and intermediate portions 174. Conductors 170 are preferably formed of stamped sheet metal, such as phosphor bronze.

FIG. 11 illustrates a sectional view of the central portion of a stamped and formed conductor 170 positioned between barrier walls 149, 149' of FIG. 9. In assembling a conductor 170 into housing 112, end 17' is initially inserted through aperture 168 in barrier wall 149. Aperture 168 is located with the aid of tapered or countersunk area 169. Upon continued insertion, enlarged central portion 172 plasticly deforms aperture 168 momentarily before attaining the position illustrated in FIG. 11. The wedge-shaped sector 175 then seats within the tapered portion 169 in wall 149 to further secure conductor 170 against longitudinal movement and to firmly seat and properly locate the conductor. Thereafter, the end portions of the conductors are bent with the aid of forming tools (as described above) to provide spring contact portions.

It may be appreciated that the unitary housing illustrated in FIGS. 2, 6 and 9 may be used with either drawn wires or stamped and formed conductors. Other means of retaining the conductors through the central partition wall or walls will be apparent to a person of ordinary skill in the art. It is therefore to be understood that within the scope of the appended claims, the invention may be practiced otherwise than as specifically described herein.

I claim:

1. A double-ended modular jack, which comprises:

a dielectric housing having first and second ends, a central housing portion, first and second plug-receiving cavities extending inwardly from said first and second ends, respectively, said first and second cavities adapted to receive, respectively, first and second modular plugs therein, and partition means extending approximately through said central housing portion;

said modular plugs each including a plurality of substantially planar, side-by-side, insulation-piercing contact terminals;

a plurality of electrical conductors positioned in a side-by-side spaced apart fashion in said housing, each of said conductors including a central portion and first and second spring contact portions extending generally outwardly from respective ends of said central portion into said first and second cavities, respectively, towards said first and second ends of said housing, respectively, said partition means including means for supporting said central portions of said conductors;

said first and second spring contact portions adapted to establish electrical contact with said contact terminals located in said first and second modular plugs, respectively, the ends of said first and second spring contact portions being unrestrained so as to deflect freely upon making and breaking of electrical contact with said contact terminals.

2. The modular jack as set forth in claim 1, wherein said supporting means comprises a plurality of side-by-side spaced apart apertures extending across said partition means.

3. The modular jack as set forth in claim 2, wherein each of said plug receiving cavities includes opposed inner side walls, an inner end wall extending between said opposed inner side walls, and a plurality of side-by-side spaced apart slot means formed in said inner end wall for receiving the free ends of said spring contact portions therein.

4. The modular jack as set forth in claim 3, wherein said slot means are aligned with said apertures in said partition means.

5. The modular jack as set forth in claim 4, further comprising a plurality of side-by-side, spaced walls extending substantially perpendicularly from said partition means so as to form a plurality of side-by-side, spaced slots aligned with and adjacent said apertures in said partition means.

6. The modular jack as set forth in claim 5, wherein said slots are aligned with said slot means.

7. The modular jack as set forth in claim 3, wherein said partition means separates said first and second plug-receiving cavities at the rear portions thereof.

8. The modular jack as set forth in claim 7, wherein said partition means comprises first and second inner rear walls for said first and second plug-receiving cavities, respectively.

9. The modular jack as set forth in claim 8, wherein said apertures are formed in said first and second inner rear walls and are positioned in a plane which is spaced from the plane or planes containing said inner end walls of said first and second cavities.

10. The modular jack as set forth in claim 8, wherein said inner rear walls are spaced from one another to form an elongated cavity therebetween, said central portions of said conductors extending transversely through said elongated cavity.

11. The modular jack as set forth in claim 10, wherein said central portions of said conductors include means for retaining said conductors within said apertures.

12. The modular jack as set forth in claim 11, wherein said retaining means comprises an enlarged portion of said conductors positioned within said elongated cavity.

13. The modular jack as set forth in claim 11, wherein said retaining means comprises a bent portion of said conductors positioned within said elongated cavity.

14. The modular jack as set forth in claim 8, wherein at least one of said inner rear walls includes means for facilitating proper positioning of said conductors in said apertures.

15. The modular jack as set forth in claim 14, wherein said means for facilitating proper positioning comprises a tapered entranceway to each of said apertures formed in said at least one inner rear wall.

16. The modular jack as set forth in claim 15, wherein said conductors comprise stamped and formed conductors and each include enlarged means for seating against said tapered entranceway upon full insertion thereof in the associated aperture.

17. The modular jack as set forth in claim 16, wherein said inner rear walls and said conductors further include means for preventing rotation of said conductors about their longitudinal axes in said housing.

18. The modular jack as set forth in claim 17, wherein said rotation preventing means comprises said apertures and said conductors being substantially rectangular in cross-section.

19. The modular jack as set forth in claim 8, wherein said inner end walls of said first and second cavities are respectively positioned in first and second planes, and wherein said apertures are formed in said first and second inner rear walls and are positioned in a third plane which is spaced from said first and second planes.

20. The modular jack as set forth in claim 19, wherein said first and second planes are located approximately equidistantly on opposite sides from said third plane whereby said first and second cavities are reverse images of one another.

21. The modular jack as set forth in claim 19, wherein said first and second planes are approximately coplanar and equidistantly spaced from said third plane whereby said first and second plug receiving cavities are mirror images of one another.

22. The modular jack as set forth in claim 1, wherein said first spring contact portions of said conductors extend in said first cavity generally obliquely downwardly towards said first end of said housing, and said second spring contact portions of said conductors extend in said second cavity generally obliquely upwardly towards said second end of said housing.

23. The modular jack as set forth in claim 22, wherein said housing includes opposed outer end walls, and wherein said central portions of said conductors extend through said housing approximately midway between said opposed outer end walls.

24. The modular jack as set forth in claim 1, wherein said first and second spring contact portions of said conductors extend generally obliquely towards said first and second ends of said housing, respectively.

25. The modular jack as set forth in claim 24, wherein both said first and second spring contact portions of said conductors extend in the same sense within said first and second cavities, respectively, whereby the signals on the respective contact terminals of said first and second modular plugs will be positionally transposed.

26. The modular jack as set forth in claim 24, wherein said first and second spring contact portions of said conductors extend in the opposite sense within said first and second cavities, respectively, whereby the signals on the respective contact terminals of said first and second modular plugs will be positionally matched.

27. The modular jack as set forth in claim 1, further comprising means selectively attachable to said housing for shorting together at least two of said second spring contact portions of said conductors in the absence of contact terminals of said second modular plug electrically contacting said at least two second spring contact portions.

28. The modular jack as set forth in claim 27, further comprising means formed on said housing for mounting said shorting means.

29. The modular jack as set forth in claim 28, wherein said shorting means comprises a metallic shorting bar having at least two fingers integrally extending from said bar and adapted to contact said at least two second spring contact portions of said conductors upon withdrawal of said second modular plug from said second cavity.

30. The modular jack as set forth in claim 1, wherein said housing comprises a single piece of molded plastic.

31. The modular jack as set forth in claim 1, further comprising means for mounting said housing to an apertured panel.

32. The modular jack as set forth in claim 31, wherein said housing further includes opposed outer side walls and outer end walls extending between said first and second ends, and said mounting means comprises a flange positioned at said second end of said housing and extending peripherally beyond said outer side walls and end walls.

33. The modular jack as set forth in claim 32, wherein said mounting means further comprises a pair of complementary spring-arms flexibly extending respectively from said opposed outer side walls for securing said housing in the aperture of the panel.

34. The modular jack as set forth in claim 33, wherein each of said spring arms includes an outer, serrated surface adapted to grip the inner opposed edges of said aperture in said panel.

35. The modular jack as set forth in claim 1, wherein said conductors each comprise unitary, bare stamped and formed conductors.

36. The modular jack as set forth in claim 35, wherein each of said stamped and formed conductors include:

means for facilitating proper seating thereof in said housing;

means for retaining same in said housing;

and means for preventing rotation thereof in said housing.

37. The modular jack as set forth in claim 36, wherein said proper seating facilitating means comprises a wedge-shaped enlargement stamped in said conductor and adapted to be seated within a complementary-shaped recess in said housing.

38. The modular jack as set forth in claim 36, wherein the retaining means comprises an enlargement stamped in said central portion of said conductor and adapted to be press-fit through a retaining aperture in said housing.

39. The modular jack as set forth in claim 36, wherein said rotation preventing means comprises said conductor being shaped rectangular in cross-section and adapted to be positioned through a similarly shaped aperture in said housing.

40. The modular jack as set forth in claim 1, wherein said partition means is integral with said housing and is unitary in construction.

41. The modular jack as set forth in claim 1, wherein said conductors are substantially S-shaped before and during mating with said first and second modular plugs.

42. The modular jack as set forth in claim 1, wherein said central portions of said conductors are substantially parallel to the longitudinal axis of said housing.

43. The modular jack as set forth in claim 1, wherein said central portions of said conductors are substantially immobile.

44. The modular jack as set forth in claim 1, wherein said plurality of conductors are substantially identical to each other in dimensions and orientation in said housing.

45. A double-ended modular jack, whih comprises:

a dielectric housing having first and second ends, first and second plug-receiving cavities extending inwardly from said first and second ends, respectively, each of said cavities adapted to receive a modular plug therein;

a plurality of electrical conductors positioned in a side-by-side spaced apart fashion in said housing, each of said conductors including a central portion and first and second spring contact portions extending generally outwardly from respective ends of said central portion into said first and second cavities, respectively, towards said first and second ends, respectively of said housing;

said first and second spring contact portions adapted to establish electrical contact with aligned contact terminals located in said first and second modular plugs, respectively;

wherein said first and second spring contact portions of said conductors extend respectively in said first and second cavities generally obliquely upwardly towards said first and second ends of said housing, respectively.

46. A modular electrical connector, which comprises:

a dielectric housing having first and second end portions;

first and second openings formed in said first and second end portions, respectively, and adapted to receive first and second modular mating plugs of the type having a plurality of insulation-piercing, side-by-side, substantially planar contact terminals positioned therein;

said first opening defined by a first inner end wall, first opposed inner side walls and a first partition formed between said first inner side walls, said first partition including a first plurality of side-by-side apertures formed therein, said first inner end wall including conductor receiving slot means formed therein;

said second opening defined by a second inner end wall, second opposed inner side walls and a second partition formed between said second inner side walls, said second partition including a second plurality of side-by-side apertures formed therein, said second inner end wall including conductor receiving slot means formed therein;

said first and second plurality of side-by-side apertures being in substantial alignment; and a plurality of electrical conductors arranged in a side-by-side spaced apart fashion in said housing, each of said conductors including a first end portion, a second end portion, and a central portion between said end portions, said central portion extending through one of said apertures of said first partition and an aligned aperture of said second partition whereby said central portion is supported by said first and second partitions, said first end portions extending from said central portions towards said first opening and obliquely into said conductor-receiving slot means in said first end wall, said second end portions extending from said central portion towards said second opening and obliquely into said conductor-receiving slot means in said second end wall;

said first and second end portions of said plurality of conductors forming spring contacts adapted to mate with said side-by-side contact terminals of said mating plugs, said first and second end portions being unrestrained so as to deflect freely upon mating and unmating with said side-by-side contact terminals of said mating plugs.

47. The connector as set forth in claim 46, wherein said modular plugs further include a latching arm extending integrally therefrom, and wherein said openings each include means for selectively retaining said latching arm of the associated plug.

48. The connector as set forth in claim 46, wherein said first and second plurality of side-by-side apertures are positioned approximately midway along the height of said first and second partitions.

49. The connector as set forth in claim 46, further comprising an elongated cavity formed between said first and second partitions, said central portions of said conductors extending transversely through said elongated cavity.

50. The connector as set forth in claim 46, wherein said first and second openings are mirror images of one another with respect to a plane positioned midway therebetween and substantially perpendicular to said conductors, whereby the signals on the respective contact terminals of said first and second modular mating plugs will be positionally transposed.

51. The connector as set forth in claim 46, wherein said first and second openings are reverse images of one another, whereby the signals on the respective contact terminals of said first and second modular mating plugs will be positionally matched.

52. The connector as set forth in claim 46, wherein said housing comprises a unitary plastic molded piece.

53. The connector as set forth in claim 46, 50 or 51, wherein said housing further includes opposed outer side walls and outer end walls extending between said first and second ends, and further comprising means extending integrally from said housing for securing said housing within an aperture formed in a panel.

54. The connector as set forth in claim 53, wherein said securing means comprises:

a flange positioned at one of said first or second ends of said housing and extending peripherally beyond said outer side walls and end walls;

a pair of complementary spring arms integrally extending respectively from said opposed outer side walls; and a plurality of teeth formed on the outer surface of each of said pair of spring arms for lockingly engaging the inner edges of said aperture in said panel.

* * * * *